United States Patent [19]

Mendenhall

[11] Patent Number: 5,075,119

[45] **Date of Patent: * Dec. 24, 1991**

[54] MICROWAVABLE PACKAGE FOR PACKAGING COMBINATION OF PRODUCTS AND INGREDIENTS

[75] Inventor: Abraham H. Mendenhall, Morris County, N.J.

[73] Assignee: Packaging Concepts, Inc., St. Louis, Mo.

[ * ] Notice: The portion of the term of this patent subsequent to Feb. 21, 2006 has been disclaimed.

[21] Appl. No.: 551,643

[22] Filed: Jul. 9, 1990

Related U.S. Application Data

[63] Continuation of Ser. No. 246,083, Sep. 19, 1988, abandoned, which is a continuation of Ser. No. 928,557, Nov. 10, 1986, Pat. No. 4,806,371.

[51] Int. Cl.[5] ..... B65D 81/32; B65D 81/34

[52] U.S. Cl. ..... 426/113; 426/107; 426/118; 426/111; 426/120

[58] Field of Search ..... 426/120, 113, 107, 234, 426/115, 112, 412, 111, 118, 395; 383/38, 101, 104, 103; 219/10.55 E; 206/219

[56] References Cited

U.S. PATENT DOCUMENTS

| | | | |
|---|---|---|---|
| 2,595,708 | 5/1952 | Salfisberg | 426/118 |
| 2,899,318 | 8/1959 | Long | 426/120 |
| 3,074,544 | 1/1963 | Bollmeier et al. | 426/120 |
| 3,108,881 | 10/1963 | Shaw et al. | 426/412 |
| 3,171,581 | 3/1965 | Kugler | 426/115 |
| 3,204,760 | 9/1965 | Whiteford | 426/113 |
| 3,293,048 | 12/1966 | Kitterman | 426/113 |
| 3,511,436 | 5/1970 | Kessler | 426/106 |
| 3,589,272 | 6/1971 | Bouladon | 99/295 |
| 3,637,132 | 1/1972 | Gray | 229/DIG. 14 |
| 3,716,369 | 2/1973 | Perlman | 426/412 |
| 3,997,677 | 12/1976 | Hirsch | 426/118 |
| 4,133,896 | 1/1979 | Standing et al. | 426/120 |
| 4,141,487 | 2/1979 | Faust | 426/113 |
| 4,233,325 | 11/1980 | Slangan et al. | 426/113 |
| 4,261,504 | 4/1981 | Cowan | 426/118 |
| 4,358,466 | 11/1982 | Stevenson | 426/113 |
| 4,450,180 | 5/1984 | Watkins | 426/107 |
| 4,557,377 | 12/1985 | Maloney | 383/38 |
| 4,571,337 | 2/1986 | Cage et al. | 426/113 |
| 4,596,713 | 6/1986 | Burdette | 426/107 |
| 4,806,371 | 2/1989 | Mendenhall | 426/113 |

FOREIGN PATENT DOCUMENTS

| | | | |
|---|---|---|---|
| 2314112 | 6/1975 | France | 426/410 |
| 60-24168 | 2/1985 | Japan | 426/113 |
| 697723 | 9/1953 | United Kingdom | 426/120 |

*Primary Examiner*—Steven Weinstein
*Attorney, Agent, or Firm*—Paul M. Denk

[57] ABSTRACT

A microwave package for packaging a combination of products and ingredients, including a package formed as a bag and constructed of paper, polymer film, or the like, having collapsible gussets formed at each side, a first product chamber formed internally at a lower location of the package, at least a pair of heat seals formed upwardly of the bag, and one or more upper chambers formed therein for holding of seasoning and flavoring ingredients within said upper chambers, while a food product, or the like, to be cooked as arranged within the lower formed chamber, so that during microwaving, said seals are strategically broken due to generated heat and pressure to provide for a deposition of the flavoring onto the cooked or cooking food product to provide a readily servable food fully seasoned upon conclusion of its microwave cooking.

4 Claims, 3 Drawing Sheets

MICROWAVABLE PACKAGE FOR PACKAGING COMBINATION OF PRODUCTS AND INGREDIENTS

This application is a continuation of Ser. No. 07/246,083, filed Sept. 19, 1988, mow abandoned, which is a continuation of the application having Ser. No. 928,557, filed on Nov. 10, 1986, and which application is now U.S. Pat. No. 4,806,371.

BACKGROUND OF THE INVENTION

This invention relates generally to a package which may contain a variety of multi-food products, suitable for convenient cooking in microwave ovens, and further includes one or more additional ingredients that are addable to the cooked or cooking food products while being serviced in such microwave ovens.

Packages of the indicated type are known. Bags of this type are manufactured by a variety of companies, and generally such bags are designed for holding food products which may be chilled or refrigerated, or even frozen,. while during storage, in preparation for usage, and then may be added directly to the microwave oven for instantaneous heating and cooking.

In addition, bags of this type are also fabricated of the self-opening style (SOS) with gussets provided along the sides thereof whereby the mouth of the bag can be opened by pulling at discrete locations, such as at the diagonally opposite corners of the bag in order to facilitate quick access therein.

In accordance with this invention, there is provided a microwavable package which cooks two or more different food ingredients at the same time, but in separate chambers within the package. Said products are normally incompatible during storage and thus requiring mixing, or combining either sometime during the cooking cycle or at the end of said cycle. Various ingredients cannot be mixed together prior to cooking generally because they are incompatible in storage, or because the flavor desired in the final cooked product cannot be achieved if the two or more ingredients are combined during preparation, or while in storage, or prior to cooking. Accordingly, the two or more ingredients should only be combined after they have been cooked or during cooking in the microwave oven. Also, it is inconvenient or impractical to require the user to provide the second or other ingredient independently after or during the microwave cooking of the first ingredient, or the product itself, since the ingredients may not be readily available to the user, or it may not be practical or safe to interupt the cooking cycle to add such additional ingredients.

Examples of food products of the indicated type are: expandable snack food with highly seasoned powder flavoring; expandable snack food with oil or lard and a third ingredient of flavoring; popcorn with liquid or dry flavors that cannot be premixed with oil; and, food or snack food requiring oil or flavor or both for oil and flavor or oil or not compatible.

In accordance with this invention, there is provided a package which maintains two or more ingredients of a food product in separate compartments within the package and in an arrangement such that they are kept separate during storage, but that they can be combined easily and automatically at the end or during the microwaving cooking process at predetermined times and in a very convenient way to the consumer.

Briefly stated, the method of making a microwavable package in accordance with this invention comprises the steps of initially placing a microwavable bag in an upright open position and delivering a quantity of the first ingredient into the interior of the bag; applying a specially developed seal of a predetermined width, configured at a predetermined dwell, pressure and temperature and designed having opening time which will sustain in enclosure the first ingredient in a first compartment in the lower segment of the formed package, and then delivering a quantity of a second, or more, ingredient of the product into the interior portion of the package above the first seal; and then applying a second specially designed seal of a predetermined width and configuration with specific dwell, temperature and pressure, designed having a specific opening time, to the upper end of the package to enclose said second ingredient, etc., in a second, etc., compartment at the upper portion of the package adjacent the said first compartment. The first and second seals are formed by application of the specific pressure, specific heat, and dwell. Said seals are constructed and arranged so that the first and second seals are caused to be fractured at predetermined times during the cooking cycle. The highest or last seal is designed to open only at the end of the cooking cycle, after all of the subsidiary packaging compartments, holding the variety of ingredients, have initially opened, under the cooking pressure generated and developed within the main compartment of the package, so that when the final upper seal is opened, and the product or food has been fully cooked within the microwave oven, all the homeowner, or chef, need to do is simply remove the package from the oven, and it is ready to be dispensed into serving dishes, onto a plate, or the like.

Additional seals in any of a variety of locations can be designed, if necessary, with a type of configuration to allow the steam and pressure to by-pass the first seal, and vent out of the top of the package, if this should necessarily be accomplished before any of the seasonings, other ingredients, or the like, are descended for mixing into the main food or other product primarily being cooked.

DESCRIPTION OF THE PREFERRED EMBODIMENT

Figure 1:
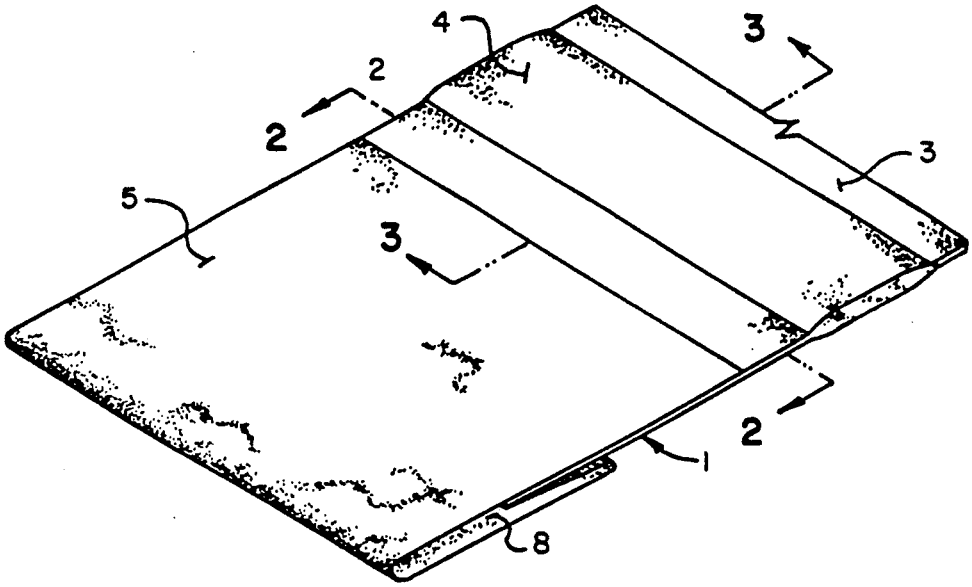
FIG. 1 is an isometric view of a microwavable package formed in accordance with this invention.
Figure 2:
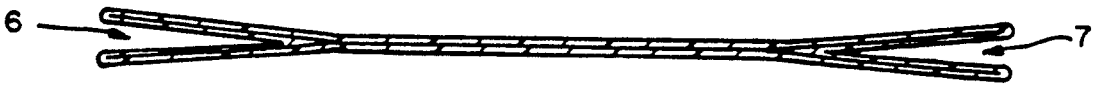
FIG. 2 is a sectional view taken along the line 2—2 of FIG. 1.
Figure 3:
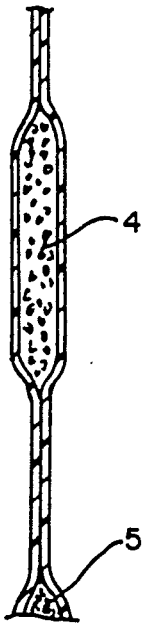
FIG. 3 is a sectional view taken on the line 3—3 of FIG. 1.

In referring to the drawings, and in particular FIGS. 1 through 3, the microwavable package in accordance with this invention comprises the shown package 1 which is preferably of the automatic or self-opening style bag, as previously identified, which is well known in the art. The bag is fabricated in the usual style, having bottom closure panel which is adhesivably applied together into closure in order to maintain the integrity of the bottom of the bag, and does not have any releasable sealing function depicted for the remaining portions of this particular structured package. As shown in FIG. 1, the bag has a transversely extending middle seal 2, extending across a medial and transverse portion of the bag, and in addition, has a further transversely extending top seal 3, extending across at the top end forming the mouth opening of the package. These seals 2 and 3 function to provide two bag compartments, as at 4 and 5, and which contain the two ingredients which are to be maintained in a separated condition during storage and distribution of the bag and prior to its application and exposure to the microwave cooking process, by the end user.

In addition, the bag is fabricated of the type having gussetted side edges, as at 6 and 7, in order to facilitate the collapse of the bag after its manufacture, its filling with ingredients, to add to the convenience of its storage and shipment, but at the same time, allows the bag to expand into a more opened configuration, as during its usage when exposed to the radio waves generated during microwaving, as during application. As can be noted, these gussetted edges for the bag extend from its approximate bottom panel, as at 8, vertically to the upper sealed edge 3, as previously defined.

The types of materials from which the microwavable package of this invention may be formed are readily available in the art, and it may comprises packaging formed of paper, but which may be treated with special adhesives at particular locations as where heat seals, or other seals, are to be provided. In addition, the packaging may be fabricated from various types of polymers, and which polymers may either be printed or applied to the inner surface of any paper as formed, or comprise polymer type bags independently fabricated from plastic type materials in the category of plastic films such as polyester, polyethylene or related types of plastic films that may be used for forming packaging. A specific example of a polyester may comprise polyethylene therephthalate, generally known as PET. Other types of polymer film combinations may be used.

Figure 4:
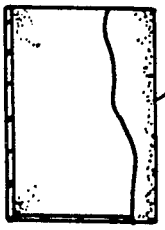
FIG. 4 is a schematic view of a product package or bag, erected, in preparation for its filling during initial processing.
Figure 5:
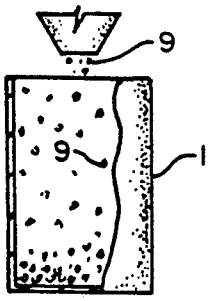
FIG. 5 shows the bag of FIG. 4 being filled with its main product.
Figure 6:
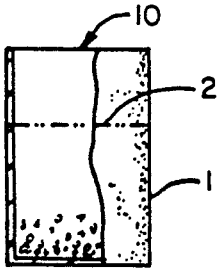
FIG. 6 shows the package of FIG. 5 after the product has been added therein, and an initial heat seal has been made at the upper end of the product chamber.
Figure 7:
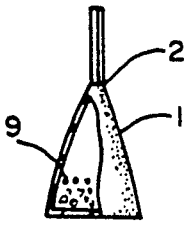
FIG. 7 is a side view of the filled package of FIG. 6.
Figure 8:
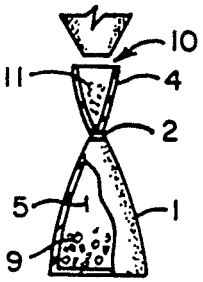
FIG. 8 is a side view of the filled package, with the upper subsidiary chamber receiving the addition of another ingredient therein.
Figure 9:
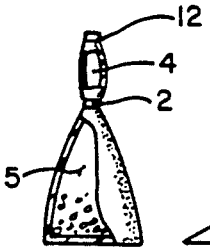
FIG. 9 is another side view of the package of FIG. 8, wherein a second heat seal has been made along the upper margin of the subsidiary ingredient chamber.

The method of making the microwavable package in accordance with this invention, and its usage, is shown in FIGS. 4 through 13. The first step in the method is illustrated in FIG. 4, and involves taking the fabricated bag 1 from a supply thereof and placing in an upright and opened position, with the mouth being opened vertically and upwardly, as shown. The next step in the method is shown in FIG. 5, and involves delivering a predetermined quantity of the first ingredient, as at 9, of the food product into the interior of the bag. For example, this may comprise popcorn kernels, or the like. In the next assembly, as shown in FIGS. 6 and 7, this comprises an initial sealing of the bag 1 at a predetermined height from the bottom thereof, as at a medial location previously identified at 2, but yet spaced sufficiently below and away from the opened mouth of the bag, as shown at 10. This initial seal 2 has a specific seal width and configuration compatible with the expansion of the ingredients 9 in addition to any steam pressure generated within the compartment 5 during a microwave cooking process of the food product. By applying the seal 2, at the location as shown, encloses the first ingredient 9 within its first compartment 5, as can be seen. The next step in the process is shown in FIG. 8, and comprises placing the bag in a position with the upper portion or open mouth 10 of the bag in a vertical and erected condition , as shown, and delivering a predetermined quantity of a second ingredient 11, from its ingredient supply bin, as can be seen, arranged thereabove, depositing it into the interior of the upper portion of the bag, and above its initial seal 2, as can be noted. This is generally deposited within that upper compartment 4, as previously analyzed. Following this, the final step in the process is shown in FIG. 9, and comprises the applying of a second seal 12 to the top of the bag, as shown, to enclose the second ingredient 11 in the upper segment or compartment 4 of the shown bag.

Figure 10:
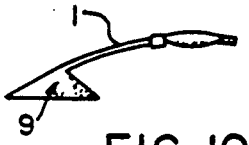
FIG. 10 shows the food package, as it is folded over in preparation for shipment and retailing, thereby affording reduced size.

The completed microwavable package shown in FIG. 10, and the value of the gusset side edges, as at 6 and 7, can be better understood on viewing this particular disclosure, since it can be seen that the package may be generally collapsed, down to that location where the ingredient 9 locates, in order to generally provide a flattened configuration for the prepared bag, to facilitate its transit and storage. The types of ingredients that will normally be used in conjunction with a packaging of this style may generally be of two types: The initial ingredient, or the main ingredient 9, as previously explained, will usually be the product in the lower chamber that will be subject to expansion into the shape and size of the finished product, with popcorn being a prime example of this type of main ingredient. The other ingredients that are added into the completed package, and generally at its upper segment 4, will comprise various types of seasoning powders, such as taco, chili powders, and examples of this type. In addition, oils, lard, vegetable oils, are examples of flavoring type ingredients, the former which may be added and intermixed with the main product, so as to provide it with a flavoring and taste equivalent to that of butter, as in the example of popcorn. Salt may also be included within the upper compartment 4, both of the regular and flavored types. Coatings, with examples being that of gravies, caramel, butterscotch, cheese, etc., could likewise be located within the upper compartment 4, in order to add these type of flavorings and coatings to the finished product, as where popcorn may be the example.

Generally, the main ingredient would be located within that compartment 5, and in a practical application, may comprise between about 50 to 125 grams, depending upon the cost, end use desired, the type of snack involved, and the size of the package required, such as, for example, where a family size may be desired. The ingredients located within the upper compartment 4 can be in a wide variety of quantities, depending upon whether they may be of the flavoring powder, the solid lard, of liquid oil, a semi-liquid cheese, etc. In the use of an oil, for example, experiements have indicated that from 30 to 125 grams may be desired.

As also previously alluded to, the individual heat seals, forming the seals 2 and 12, as previously explained, need to be specifically designed and configured so as to accommodate the individual and combinations of the various ingredients to accomplish the objective of providing an initial break of the first seal 2, to allow the ingredients to drop down into the main food product, followed by, perhaps, a partial or full opening of the upper seal 12, after completion of the microwave procedure. On the other hand, as previously explained, and as applied in the prior art, it may be that the upper seal 12 will be designed to not open during the microwave processing, so that the user him/herself may simply pull upon diagonal corners of the gusseted package, in order to provide an opening at the time of usage. But, it is the desired objective of this invention to provide seals that will open at particular times in order to afford a proper "mixing" of the various ingredients, and the main food product or ingredient, either during or just at the conclusion of the microwaving heating.

A more specific example of the type of products to be used within the microwave package of this invention includes a one/half or more product of a snack food type, being packaged within the lowder chamber 5 of a bag generally having dimensions of 6 inches wide, 3 to 4 inches in depth, and 9 inches high. The first seal 2 was made with a one-eighth inch heat bar, the smooth face of the bag being sealed at approximately 325° F. for 3/10 seconds on both sides at a ¾ inch heighth location. A seasoning was placed in the upper compartment. A second seal 12 was made at approximately one inch down from the top of the bag, with a one inch heat bar, forming a smooth surface when treated at approximately 325° F., and 3/10 second dwell. This gave the desired effect repeatedly for one-half of the product as it was expanded in the microwave oven set as for a two minute cook, at a medium range, with popcorn being the type of snack food. The seal 2 separated during the last 10 seconds of the two minute cycle, dropping the seasoning previously located between the seals 2 and 12, onto the expanded product located within the lower chamber 5. The user removed the cooked product from the oven, give it a couple of shakes in order to intermix the upper and lower ingredients, and then opened the seal 12 by pulling the designated corners of the gussets without any detrimental damage to the package itself Sampling of the seasoned expanded snack food exhibited a food product which was fully seasoned from the convenient combination of these components within the food package, with the product being fully cooked for consumption.

Figure 11:
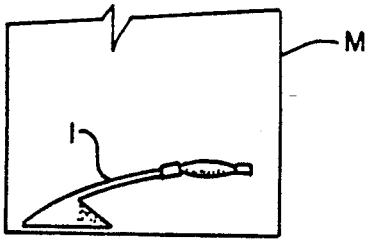
FIG. 11 shows the completed package as it is delivered into a microwave oven in preparation for cooking.
Figure 12:
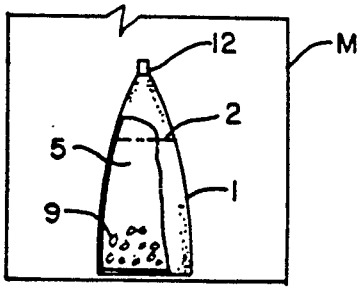
FIG. 12 is a view of the microwavable package of this invention during its processing within a microwave oven.
Figure 13:
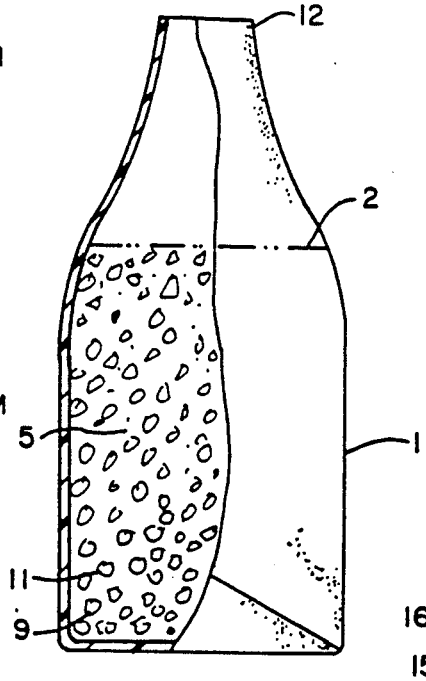
FIG. 13 shows the package of this invention after it has been fully cooked, in addition to its upper ingredient chamber having been opened for deposition of its flavoring, etc., to the food or other product cooked therebelow.

This procedure of cooking the identified food product was accomplished in the manner as also shown in FIGS. 11 through 13, and in this particular instance, the food package 1 was located within the microwave oven M, as shown in FIG. 11. During the cooking procedure, by exposing the packaged ingredients to the microwave radiation, the package, as can be seen in FIG. 12, initially broke its seal 2 due to the expansion of the snack product, being popcorn, as shown at 9. The combination of heat and steam pressure that builds up within the compartment 5, due to ingredient cooking. But, as can be seen, while the seal 2 is broken, and its flavoring ingredient has descended into and intermixed with the product 9, the upper seal 12 was yet still intact, until approximately 10 seconds before the conclusion of the microwaving process. At that time, and as can be seen in FIG. 13, the upper seal 12 was also forced open, due to the generated pressure, to provide a ready prepared food product, fully seasoned, and readily opened for application by the user.

Figure 14:
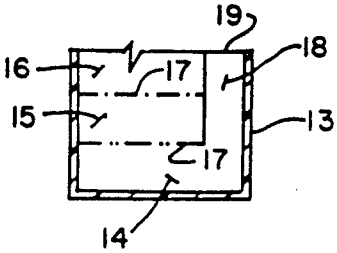
FIG. 14 is a schematic view of a modified package wherein a pair or more of upper subsidiary ingredient compartments are provided partially to the side, and having a vent chamber, leading from the main product chamber, located along the right margin of the identified package.

FIG. 14 provides a schematic view of a modified package 13, and which is designed to provide a lower compartment 14 in which the main food product locates, but the package is segmented in its upper section, so as to provide a pair or more of upper chambers 15 and 16, fully sealed along their seal lines 17, in order to provide, during the microwave cooking procedure, an eventual breaking of these seals for deposition of their separately held ingredients to the cooking or cooked product located therebelow. In addition, as can be seen, an escape path 18 is provide along one margin, such as the right margin as shown, of the package 13, with an upper sealed edge, as at 19, provided for breaking at one predetermined time, depending upon the type and degree of seal formed, so as to provide venting of a pressure and steam in coordination with the deposition of any supplmental ingredients held within the subchambers 15 and 16, as explained.

Figure 15:
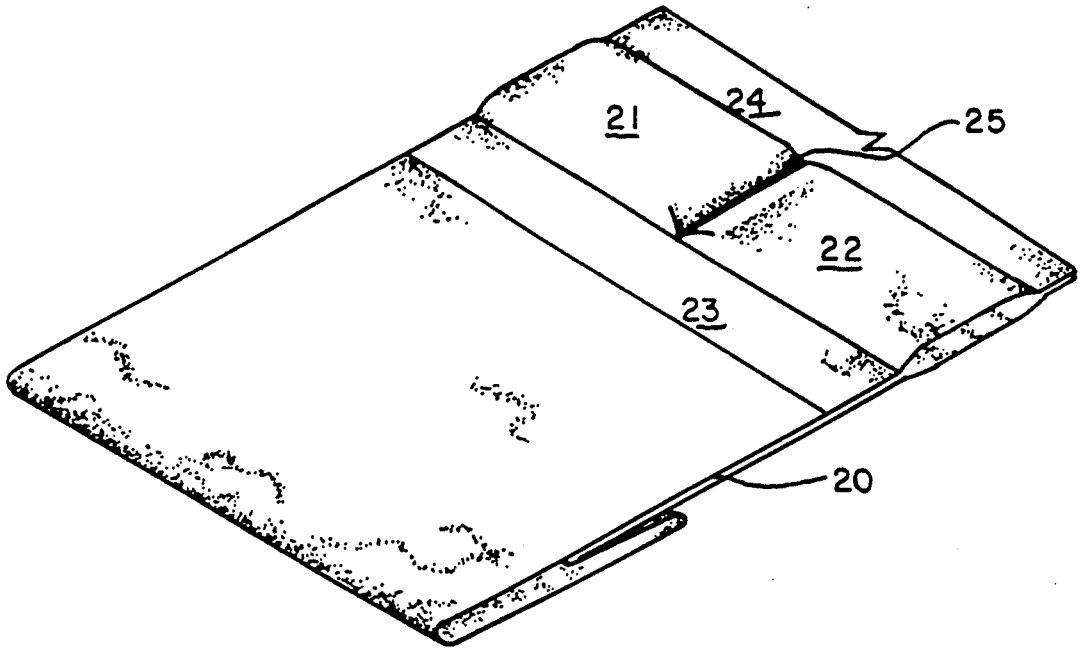
FIG. 15 shows a modified package of this invention wherein a pair of ingredient compartments may be provided transversely along the upper margin of the microwavable package.
Figure 16:
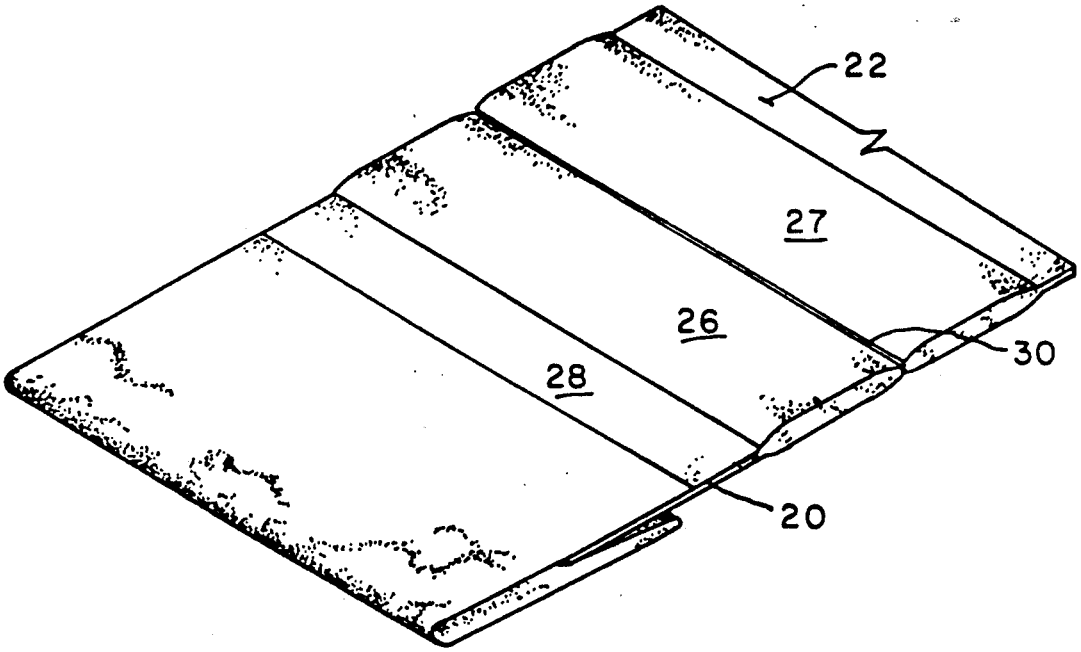
FIG. 16 shows a modified microwavable package having a pair of ingredient chambers provided vertically aligned proximate the upper segment of the shown package.

Further examples as to how the microwave package of this invention may be fabricated and modified to form a plurality of segregated upper compartments are shown in FIGS. 15 and 16. As can be seen, the microwave package 20 may be formed with a pair of upper chambers 21 and 22, transversely proximate the upper edge of the package, having seals 23 through 25 provided at discrete locations, and which operate in the manner as previously analyzed. In addition, FIG. 16 shows how the package 20 may have a pair of subsidiary chambers 26 and 27 vertically aligned, one above the other, and formed through the location of seals 28 and 30, as can be noted.

Variations or modifications to the subject matter of this invention may occur to those skilled in the art upon reviewing the invention described herein. Such variations, if within the spirit of this invention, are intended to be encompassed with the scope of any claims to patent protection issuing upon this invention. The description of the preferred embodiment set forth herein, in addition to the drawings, are set forth for illustrative purposes only.

Having thus described the invention what is claimed and desired to be secured by Letters Patent is:

1. A microwave package for packing a combination of products and ingredients, comprising, a package formed as a bag and constructed of a material selected from the group consisting of paper, polymer film, and either polymer or adhesive lined paper, the bag having side walls, each side wall formed of a collapsable gusset, and said bag having front and back walls, each integrally formed with said side walls, and a bottom wall provided at the lower end of the bag, and integrally formed with the said front, back, and side walls, and said bag having an open top located at the top of the bag, a first product chamber formed internally at a lower location in the bag above the bottom wall, and containing a product to be heated by microwave energy therein, a pair of ingredient chambers provided upwardly within the bag and above the said product chamber and below the open top of the bag, said pair of ingredient chambers being arranged adjacent each other and relative to each other, transversely of the bag from one side wall of the bag towards the other side wall of the bag, with said ingredient chambers provided to be broken to selectively deposit their respective ingredients onto the cooking product during microwaving, one of said ingredient chambers containing a material selected from a group consisting of oil, lard, vegetable oil, and butter, with the adjustably arranged ingredient chamber containing a material selected from the group consisting of seasoning powder, salt, and flavor ingredient, said ingredient chambers being defined and formed through a series of seals between select walls of the bag, a first seal formed between the front and back walls and extending transversely from one side wall of the bag towards the other side wall of the bag, said first seal being formed at and defining the bottom of said pair of adjacent ingredient chambers between said ingredient chambers and the formed bag product chamber therebelow, a longitudinally extending second seal formed between the front and back walls and located between the said ingredient chambers and extending longitudinally from the said transversely extending first seal to the said bag normally opened top, and an upper transverse extending third seal formed between the front and back walls and disposed across the open top of the formed microwave bag, above the pair of transversely adjacent ingredient chambers to seal the open top of the bag and thus the chambers and the bag, a vent chamber located either laterally adjacent or intermediate the ingredient chambers and disposed for venting the accumulated pressure during microwaving of the product contained within the product chamber, said vent chamber extending from the product chamber to the upper transversely extending third seal of the said bag, a vertically oriented fourth seal formed between the front and back walls and located adjacent the vent chamber and one of the ingredient chambers and in combination with either said second seal or side wall of the bag defining the said vent chamber, said first seal subject to controlled rupture during microwaving of the product under the exertion of the pressure generated within the product chamber during microwaving, wherein the said first seal forming the ingredient chambers is broken to selectively deposit the material from their ingredient chambers onto the cooked product during microwaving, and said third seal at the vicinity of the vent chamber capable of rupturing for allowing for the eventual venting of any further generated steam and pressure within the product chamber during product cooking through a venting of the generated steam from the product chamber and through the vent chamber and a rupturing of the proximate upper seal to provide for the escape of said steam and pressure to exteriorly of the said bag, while said ingredients are deposited into the product chamber and upon its contained product during performance of a microwave cooking procedure.

2. The invention of claim 1 and wherein said bag being formed of polyethylene terephthalate.

3. The invention of claim 2 and wherein said microwave package being collapsable.

4. The invention of claim 3 and wherein said product subject to microwaving comprising popcorn kernels.

* * * * *